US010321242B2

(12) United States Patent
De Vries et al.

(10) Patent No.: US 10,321,242 B2
(45) Date of Patent: Jun. 11, 2019

(54) AUTOMATED SCANNING FOR HEARING AID PARAMETERS

(71) Applicant: GN Hearing A/S, Ballerup (DK)

(72) Inventors: Aalbert De Vries, Eindhoven (NL); Joris Kraak, Eindhoven (NL)

( * ) Notice: Subject to any disclaimer, the term of this patent is extended or adjusted under 35 U.S.C. 154(b) by 148 days.

(21) Appl. No.: 15/219,146

(22) Filed: Jul. 25, 2016

(65) Prior Publication Data

US 2018/0007477 A1 Jan. 4, 2018

(30) Foreign Application Priority Data

Jul. 4, 2016 (EP) ..... 16177752

(51) Int. Cl.
*H04R 25/00* (2006.01)

(52) U.S. Cl.
CPC ..... *H04R 25/505* (2013.01); *H04R 25/00* (2013.01); *H04R 25/50* (2013.01); *H04R 25/55* (2013.01); *H04R 25/552* (2013.01); *H04R 25/554* (2013.01); *H04R 25/556* (2013.01); *H04R 25/558* (2013.01); *H04R 25/70* (2013.01); *H04R 2225/55* (2013.01)

(58) Field of Classification Search
CPC .... H04R 25/505; H04R 25/558; H04R 25/70; H04R 2225/55
See application file for complete search history.

(56) References Cited

U.S. PATENT DOCUMENTS 4,947,432 A 8/1990 Topholm
5,721,783 A * 2/1998 Anderson ..... H04B 1/385 381/312

(Continued)

FOREIGN PATENT DOCUMENTS

EP 0 814 634 A1 12/1997
EP 2 833 652 A 2/2015

(Continued)

OTHER PUBLICATIONS

Byrne et al. "NALNL1 procedure for fitting nonlinear hearing aids: Characteristics and comparisons with other procedures". *Journal of the American Academy of Audiology*. Jan. 2001. pp. 37-51. vol. 12, No. 1.

(Continued)

*Primary Examiner* — Oyesola C Ojo
(74) *Attorney, Agent, or Firm* — Vista IP Law Group, LLP

(57) ABSTRACT

A hearing aid system is provided that facilitates adjustment of signal processing parameters θ of the hearing aid system with minimum user intervention, wherein the hearing aid system is capable of calculating signal processing parameters θ for evaluation of the user when the user has entered an input, e.g. using a smartwatch, to this effect. The evaluation takes place for a certain time period and in the event that the user has entered a consent input indicating that he or she is pleased with the set θ of signal processing parameters under evaluation, the hearing aid system continues processing with those signal processing parameters; and if the user is not pleased with the signal processing parameters θ under evaluation, the hearing aid system calculates another set $\hat{\theta}$ of signal processing parameters for evaluation of the user.

39 Claims, 5 Drawing Sheets

(56) References Cited

U.S. PATENT DOCUMENTS

| | | | | |
|---|---|---|---|---|
| 6,035,050 | A * | 3/2000 | Weinfurtner | H04R 25/507 381/313 |
| 6,850,775 | B1 * | 2/2005 | Berg | H04R 25/70 381/315 |
| 6,978,155 | B2 * | 12/2005 | Berg | H04R 25/70 455/556.1 |
| 7,006,646 | B1 * | 2/2006 | Baechler | H04R 25/70 381/312 |
| 7,945,065 | B2 * | 5/2011 | Menzl | H04R 25/70 381/312 |
| 8,064,609 | B2 * | 11/2011 | Baechler | H04R 25/30 381/312 |
| 8,165,329 | B2 * | 4/2012 | Bisgaard | H04R 25/305 381/314 |
| 8,503,703 | B2 * | 8/2013 | Eaton | H04R 25/554 381/312 |
| 8,767,986 | B1 * | 7/2014 | Fabry | H04R 25/70 381/314 |
| 9,084,066 | B2 * | 7/2015 | De Vries | H04R 25/70 |
| 9,351,087 | B2 * | 5/2016 | Ypma | H04R 25/505 |
| 9,439,008 | B2 * | 9/2016 | Shennib | H04R 25/70 |
| 9,838,805 | B2 * | 12/2017 | Gran | H04R 25/407 |
| 2004/0165731 | A1 * | 8/2004 | Ribic | H04R 25/558 381/60 |
| 2010/0008523 | A1 * | 1/2010 | Demuynck | G06F 1/1616 381/182 |
| 2010/0008526 | A1 * | 1/2010 | De Vries | H04R 25/70 381/314 |
| 2010/0183161 | A1 * | 7/2010 | Boretzki | A61B 5/121 381/60 |
| 2011/0249839 | A1 * | 10/2011 | Mindlin | H04R 25/43 381/314 |
| 2012/0051569 | A1 * | 3/2012 | Blamey | H04R 25/70 381/314 |
| 2012/0087524 | A1 * | 4/2012 | Howes | H04R 25/70 381/314 |
| 2012/0183163 | A1 * | 7/2012 | Apfel | H04R 25/70 381/314 |
| 2012/0183165 | A1 * | 7/2012 | Foo | H04R 25/50 381/314 |
| 2012/0237064 | A1 * | 9/2012 | Garratt | H04R 25/70 381/314 |
| 2013/0022223 | A1 * | 1/2013 | Kehtarnavaz | H04R 25/70 381/317 |
| 2015/0036851 | A1 * | 2/2015 | Howes | H04R 25/554 381/314 |
| 2015/0124984 | A1 * | 5/2015 | Han | H04R 25/43 381/60 |
| 2015/0172831 | A1 * | 6/2015 | Dittberner | H04R 25/70 381/314 |
| 2016/0057547 | A1 * | 2/2016 | Burger | H04R 25/00 381/315 |
| 2016/0309267 | A1 * | 10/2016 | Fitz | H04R 25/558 |
| 2017/0078809 | A1 * | 3/2017 | Solum | H04R 25/554 |
| 2017/0201839 | A1 * | 7/2017 | Manchester | H04R 25/554 |
| 2017/0359659 | A1 * | 12/2017 | Von Brasch | H04R 25/30 |

FOREIGN PATENT DOCUMENTS

| | | | |
|---|---|---|---|
| EP | 2871858 | A1 | 5/2015 |
| EP | 2 884 766 | A1 | 6/2015 |
| WO | WO 02/089520 | A2 | 11/2002 |
| WO | WO 2007/042043 | A2 | 4/2007 |

OTHER PUBLICATIONS

Cornelisse et al. "The input/output formula: a theoretical approach to the fitting of personal amplification devices". *Journal of the Acoustical Society of America*. Mar. 1995. pp. 1854-1864. vol. 97, No. 3.

Thompson, William. "On the likelihood that one unknown probability exceeds another in view of the evidence of two samples" *Biometrika*. 1993. pp. 285-294.

Extended European Search Report dated Feb. 14, 2017 for corresponding EP Patent Application No. 16177752.9, 7 pages.

* cited by examiner

AUTOMATED SCANNING FOR HEARING AID PARAMETERS

RELATED APPLICATION DATA

This application claims priority to, and the benefit of, European Patent Application No. 16177752.9 filed on Jul. 4, 2016, pending. The entire disclosure of the above application is expressly incorporated by reference herein.

FIELD

A hearing aid system is provided with an adjustment processor capable of suggesting various settings of the hearing aid system for user evaluation and possible selection with a minimum of user interaction.

BACKGROUND

Hearing loss is an important problem that affects the quality of life of millions of people. About 15% of American adults (37.5 million) reports problems with hearing. For most cases, the problem relates to frequency-dependent loss of sensitivity of hearing. In FIG. 1, the bottom (dashed) curve corresponds to the Absolute Hearing Threshold (AHT) as a function of frequency. The AHT is the sound level that is almost audible for normal hearing subjects. The top (dash-dotted) curve represents the Uncomfortable Loudness Level (UCL) for the average normal hearing population. Generally speaking, human sensitivity to acoustic inputs deteriorates with age. The raised hearing threshold for a particular person may be represented by the middle (solid) curve in FIG. 1. Now consider an ambient tone at intensity level $L_1$ as indicated by the black circle. This signal would be heard by a normal listener but not by the impaired listener. The primary task of a hearing aid is to amplify the signal so as to restore normal hearing levels for the "aided" impaired listener. Aside from signal processing that compensates for problems that occur due to insertion of the hearing aid itself (e.g., feedback, occlusion, loss of localization), an important challenge in hearing aid signal processing design is to determine the optimal amplification gain $L_2-L_1$.

Technically, the optimal gain depends on the specific hearing loss of the user and turns out to be both frequency and intensity-level dependent. In commercial hearing aids, amplification is generally based on multi-channel dynamic range compression (DRC) processing in the frequency bands of a filter bank. A typical gain vs. signal level relation in one frequency band of a DRC circuit is shown in FIG. 2. The gain is maximal for low input levels and remains constant with growing input levels until a Compression Threshold (CT), after which the logarithmic gain decreases linearly (in dB). The slope of the gain decrease is determined by the compression ratio $CR \triangleq \Delta input/\Delta(input+gain)$, which is a characteristic parameter for DRC algorithms. Aside from CT and CR, a DRC circuit is typically also parameterized by attack and release time constants (AT and RT, respectively) to control the dynamic behaviour. The crucial problem of estimating good values for the parameters CT, CR, AT and RT is an important part of the so-called fitting problem.

Today's hearing aids are usually provided with a hearing loss signal processor and a number of different signal processing algorithms including DRC. Typically, each of the signal processing algorithms is tailored to particular user preferences and particular categories of sound environment. Initial signal processing parameters of the various signal processing algorithms including CT, CR, AT, and AR, are determined during an initial fitting session in a dispenser's office and programmed into the hearing aid by activating desired algorithms and setting algorithm parameters in a non-volatile memory area of the hearing aid in question.

Modern hearing aid fitting strategies set compression ratios by prescriptive rules, e.g., the NAL rules, see D. Byrne, H. Dillon, T. Ching, R. Katsch, and G. Keidser, "NALNL1 procedure for fitting nonlinear hearing aids: Characteristics and comparisons with other procedures," Journal of the American Academy of Audiology, vol. 12, no. 1, pp. 37-51, January 2001, and DSL rules, see L. E. Cornelisse, R. C. Seewald, and D. G. Jamieson, "The input/output formula: a theoretical approach to the fitting of personal amplification devices," The Journal of the Acoustical Society of America, vol. 97, no. 3, pp. 1854-1864, March 1995, are very widely used. For the dynamic parameters AT and RT no standard fitting rules exist and most hearing aid manufacturers offer slight variations on known dynamic recipes such as slow-acting ('automatic volume control') and fast-acting ('syllabic') compression.

The goal of determining hearing aid signal processing parameters, such as CT, CR, AT, RT, utilizing prescriptive fitting rules is to provide a decent 'first-fit' of the hearing aid in question. Typically, an audiologist spends a very limited amount of time on fitting a hearing aid to each user compared to all the nuances that are associated with hearing loss. Diagnostic procedures exist which would optimize the prescribed hearing aid parameters to maximize the benefits that the user would get out of their hearing aids. Unfortunately, the time needed to carry out these procedures is prohibitive for the audiologist and instead they often resort to an automatic fitting procedure with minimal personalization. This may result in several return visits to the audiologist for the user, and too often, the user gives up and deems the hearing aid as being more of a burden than a benefit and the hearing aid ends up not being used.

Another fundamental challenge is that the user typically experiences unforeseen and changing sound environments that were not taken into account when the hearing aid was fitted to the user.

SUMMARY

In order to increase hearing aid user satisfaction levels, it is desirable that users themselves are able to personalize the users' own respective hearing aids. Hearing aid personalization involves a delicate balancing act though. While more preference feedback from users is needed to fine-tune their hearing aids, the cognitive burden-of-elicitation on hearing aid users should not substantially increase. Hence, there is a need for a hearing aid system and a fitting method of a hearing aid that make optimal use of sparsely available preference data from its user.

Thus, there is a need for a method and a hearing aid system that is capable of assisting a user of the hearing aid system in optimizing signal processing parameter settings of the hearing aid system in situations wherein the user experiences a need for an improved setting.

The Hearing Aid System

The hearing aid system comprises a first hearing aid with

- a first microphone for provision of a first audio signal in response to sound signals received at the first microphone from a sound environment,
- a first hearing loss signal processor that is adapted to process the first audio signal in accordance with a signal processing algorithm F(θ), where θ is a set (e.g., first set) of signal processing parameters of the signal processing algorithm F, to generate a first hearing loss compensated audio signal for compensation of a hearing loss of a user of the hearing aid system, a first output transducer for providing a first output signal to a user of the hearing aid system based on the first hearing loss compensated audio signal, and a first interface adapted for data communication with one or more other devices.

The hearing aid system comprises a user interface that may be accommodated in a housing of the first hearing aid or may be accommodated in another device adapted for data communication with the first hearing aid; or, part of the user interface may be accommodated in the housing of the first hearing aid and part of the user interface may be accommodated in another device adapted for data communication with the interface of the first hearing aid.

At least some of the signal processing parameters of the set θ of signal processing parameters may have been adjusted in accordance with the hearing loss of the user, e.g. during a fitting session at a hearing aid dispenser.

In Situ Fitting

The hearing aid system further comprises an adjustment processor that is adapted to calculate a set $\hat{\theta}$ (e.g., a second set) of signal processing parameters with alternate values of one or more or all parameters of the set θ of signal processing parameters and to control the first hearing loss signal processor to process the first audio signal in accordance with the signal processing algorithm F(θ) with the set $\hat{\theta}$ of signal processing parameters for user evaluation of the first hearing loss compensated audio signal, e.g. for a specific period of time.

The signal processing algorithm F may include a plurality of different signal processing sub-algorithms, such as frequency selective filtering, single or multi-channel compression, adaptive feedback cancellation, speech detection and noise reduction, etc., and one or more parameters of the set θ of signal processing parameters may function as selector(s) of specific respective signal processing sub-algorithm(s) for execution. For example, changing the value of one parameter of the set θ of signal processing parameters may change the signal processing, e.g. from omni-directional processing of the first audio signal to directional processing of audio signals from two or more microphones.

The adjustment processor may be comprised in the first hearing aid, e.g. as a part of the first hearing loss signal processor, or may be comprised in another device, e.g. a wearable device, that is adapted for data communication with the first hearing aid; or, part of the adjustment processor may be comprised in the first hearing aid and part of the adjustment processor may be comprised in another device adapted for data communication with the interface of the first hearing aid.

The adjustment processor may be adapted to calculate the set $\hat{\theta}$ of signal processing parameters, when the user has entered a specific user input, in the following termed the "dissent" input, using the user interface, e.g. by pressing a specific button, e.g. on the first hearing aid housing; or, on a housing of another device; or, touching a specific icon on a touchscreen of another device; or, by refraining from performing user entry for a specific period of time.

In the event that the user desires to continue using the hearing aid system with the signal processing algorithm F(θ) with the set $\hat{\theta}$ of signal processing parameters, the user enters a specific input, in the following termed the "consent" input, using the user interface, e.g. by pressing another specific button on the first hearing aid housing; or, on the other device housing; or, touching another specific icon on the touchscreen of the other device.

The adjustment processor may be adapted to calculate a second set $\hat{\theta}$ of signal processing parameters with alternate values of one or more or all parameters of the set θ of signal processing parameters; and, e.g., in absence of entry of the consent input and upon elapse of the specific period of time, to control the first hearing loss signal processor to process the first audio signal with the signal processing algorithm F(θ) with the second set of signal processing parameters for user evaluation of the first hearing loss compensated audio signal, e.g. for the specific period of time.

The adjustment processor may be adapted to repeat the steps of calculating a set $\hat{\theta}$ of signal processing parameters, and controlling the first hearing loss signal processor to process the first audio signal with the signal processing algorithm F(θ) with the set $\hat{\theta}$ of the signal processing parameters for user evaluation of the first hearing loss compensated audio signal, e.g. for the specific period of time, until the user has entered a consent input using the user interface; or, until the steps of calculating and controlling have been performed a specific maximum number of times, e.g. 2, 3, 4, 5, 6, 7, 8, 9, 10, etc., times, preferably more than 4 times, preferred 10 times.

In the event that the steps of calculating and controlling have been performed the maximum number of times, e.g. 10 times, without the user having entered the consent input using the user interface, the adjustment processor may be adapted to control the first hearing loss signal processor to process the first audio signal with the values of the signal processing parameters θ used by the first hearing loss signal processor immediately before the user entered the dissent input.

In the event that the user enters the consent input, the adjustment processor may be adapted to stop repeating the steps of calculating and controlling so that the first hearing loss signal processor continues processing the first audio signal with the latest signal processing algorithm F(θ) with the latest set $\hat{\theta}$ of signal processing parameters determined by the adjustment processor.

An important goal for the adjustment processor is that the set θ of signal processing parameters is interesting to the user of the hearing aid. The problem of selecting interesting values is well-known in the art of reinforcement learning as the so-called exploitation-exploration task. The present approach is based on maintaining a preference probability distribution p(θ|D) of the set θ of signal processing parameters, where D relates to observed data, for example including user entry of dissent and consent input. The preference probability distribution should be interpreted as a, possibly normalized, preference function for the signal processing parameters, i.e., If $p(\theta_1|D)>p(\theta_2|D)$, then $\theta_1$ is preferred over $\theta_2$.

The set θ of signal processing parameters is generated by drawing a sample from the preference probability distribution:

$$\hat{\theta} \sim p(\theta|D)$$

This strategy for selecting an interesting set $\hat{\theta}$ of signal processing parameters is also known as Thompson sampling, which is well-known in the art for balancing the exploitation-exploration trade-off in a desirable way.

For example, the adjustment processor may be adapted to update a utility model $$U(\theta,\omega)=\omega^T b(\theta)$$

that reflects the state-of-knowledge about user preferences for signal processing parameter values θ. Here, b(θ) is a K-dimensional set of basis functions over the M-dimensional signal processing parameter vector θ. The K-dimensional vector ω comprises model parameters for the utility model. A high utility value U(θ, ω) corresponds to a high preference for the set θ of signal processing parameters.

The expected utility is $$EU(\theta) = \int_{\omega} U(\theta, \omega) \cdot p(\omega \mid D)$$

Furthermore, a preference probability distribution of signal processing parameter values is defined by $$p(\theta \mid D) = \frac{1}{Z} e^{\gamma \cdot EU(\theta)},$$

wherein γ is a scaling parameter and Z can be obtained from the normalization condition $\int_\theta p(\theta|D)=1$.

If $p(\theta_1|D)>p(\theta_2|D)$, then $\theta_1$ is preferred over $\theta_2$.

The update processor may be adapted to determine or select a set $\hat{\theta}$ of signal processing parameters according to the preference probability distribution of signal processing parameter values p(θ|D), i.e. by Thompson sampling, cf., Thompson, William R. "On the likelihood that one unknown probability exceeds another in view of the evidence of two samples". *Biometrika,* 25(3-4):285-294, 1933.

On average, more preferred values (that have higher utility values) have a higher chance of being selected as an alternative parameter value than less preferred values, but Thompson sampling will also lead to selection of values, which, according to the utility model, are less preferred. This is a good strategy because the utility model relating to preferred values of signal processing parameters has uncertainties as specified by p(θ|D). Thus, Thompson sampling advantageously controls the exploitation-exploration trade-off that is inherent when optimizing in an unknown environment.

Learning

The adjustment processor may be adapted to learn from entries of user consent inputs and include the knowledge of the user preference of the set $\hat{\theta}$ of signal processing parameters in the current listening situation in the algorithms for calculating sets $\hat{\theta}$ of signal processing parameters, for example using Bayes rule to absorb the new information on user preference as further explained below.

The adjustment processor may be adapted to include into the preference probability distribution p(θ|D), user consent and dissent inputs received during user evaluation of the hearing loss compensated audio signal obtained with the set $\hat{\theta}$ of the signal processing parameters provided by the adjustment processor and used to process the audio signal.

As explained above, the preference probability distribution is related to a utility model U(θ, ω) that is parameterized by (utility) model parameters ω∈Ω.

Inclusion into the preference probability distribution p(θ|D) of user consent input and dissent input is performed by updating a probability distribution of the utility parameters. A Gaussian distribution may be assigned to the utility parameters:

$$p(\omega|D)=\mathcal{N}(\mu,\Sigma),$$

which is parameterized by mean μ and covariance matrix Σ.

A response model may be introduced in the form of a logistic probabilistic model for predicting client responses d given by $$p(d \mid \omega) = \frac{1}{1 + e^{-\lambda(2d-1)(U_a - U_r)}} = g(\lambda(2d-1)(U_a - U_r))$$

where $g(x)=1/(1+e^{-x})$ and $U_a=U(\theta_a, \omega)$ and $U_r=U(\theta_r, \omega)$ relate to utility values for alternative and reference signal processing parameter values, respectively.

Bayes rule may be used to include the most recent response d in the preference probability distribution by calculation of:

$$p(\omega|D,d)\propto p(d|\omega)\cdot p(\omega|D)$$

The posterior Gaussian distribution of the utility parameters, i.e. the Gaussian distribution of the utility parameters after inclusion of the most recent response d, may be parameterized by mean $\tilde{\mu}$ and covariance matrix $\tilde{\Sigma}$:

$$p(\omega|D,d)=\mathcal{N}(\tilde{\mu},\tilde{\Sigma}).$$

Bayes rule as applied above involves multiplication of a Gaussian distribution with a logistic function, which does not lead analytically to a Gaussian distribution for the resulting posterior distribution p(ω|D,d).

However, the procedure denoted "Laplace approximation" may be used to create a Gaussian posterior distribution for the utility parameters.

The Laplace approximation leads to the following update rule for updating (μ, Σ) to ($\tilde{\mu}$, $\tilde{\Sigma}$):

$$\tilde{\Sigma} = \Sigma - \frac{\hat{d}(1-\hat{d})}{\lambda^{-2} + \hat{d}(1-\hat{d})(\tilde{b}^T \Sigma \tilde{b})}(\Sigma\tilde{b})(\Sigma\tilde{b})^T$$

$$\tilde{\mu} = \mu + \lambda(d - \hat{d})\tilde{\Sigma}\tilde{b}$$

wherein $\tilde{b}=b(\theta_a)-b(\theta_r)$ and $\hat{d}=g(\lambda\omega^T\tilde{b})$.

The update rule may be carried out each time a user response d has been received.

Thus, a method of in-situ fitting of a hearing aid is provided, wherein the method comprises steps that constitutes a loop that is performed one or more times. The method and the loop include the steps of: DETECT, TRY, EXECUTE, RATE, and ADAPT, and is performed by interaction between three entities, namely 1) the user of the hearing aid, 2) the hearing loss processor, and 3) the adjustment processor.

The user performs the DETECT and RATE steps; the hearing loss processor performs the EXECUTE step, and the adjustment processor performs the TRY and ADAPT steps.

The TRY and adapt steps performed by the adjustment processor resembles a Model-Free Reinforcement Learning (MFRL) process. In a MFRL process, an agent, e.g. the adjustment processor, acts upon an external environment through actions (the TRY step) and update its own model for the environment (ADAPT step) from performance feedback (RATE steps). MFRL is also much related to Bayesian Optimization (BO). Thus, the present method connects MFRL and BO technology to in-situ hearing aid fitting.

Thus, a method is provided of in-situ fitting of a hearing aid with a microphone for provision of an audio signal in response to sound signals received at the microphone from a sound environment, a hearing loss signal processor that is adapted to process the audio signal in accordance with a signal processing algorithm $F(\theta)$, where $\theta$ is a set of signal processing parameters of the signal processing algorithm F, to generate a first hearing loss compensated audio signal for compensation of a hearing loss of a user of the hearing aid system, a first output transducer for providing a first output signal to a user of the hearing aid system based on the first hearing loss compensated audio signal, comprising the steps of TRY: calculating a set $\hat{\theta}$ of signal processing parameters with alternate values of at least one signal processing parameter of the set $\theta$ of signal processing parameters, and EXECUTE: controlling the hearing loss signal processor to process the audio signal with the signal processing algorithm $F(\hat{\theta})$ applying the set $\hat{\theta}$ of signal processing parameters for user evaluation of the first hearing loss compensated audio signal.

Further, a method is provided of in-situ fitting of a hearing aid with a microphone for provision of an audio signal in response to sound signals received at the microphone from a sound environment, a hearing loss signal processor that is adapted to process the audio signal in accordance with a signal processing algorithm $F(\theta)$, where $\theta$ is a set of signal processing parameters of the signal processing algorithm F, to generate a first hearing loss compensated audio signal for compensation of a hearing loss of a user of the hearing aid system, a first output transducer for providing a first output signal to a user of the hearing aid system based on the first hearing loss compensated audio signal, comprising the steps of DETECT: user entry of dissent, TRY: upon user entry of dissent, calculating a set $\hat{\theta}$ of signal processing parameters with alternate values of at least one signal processing parameter of the set $\theta$ of signal processing parameters, e.g. by Thompson sampling of the set $\hat{\theta}$ of signal processing parameters from a preference probability distribution $p(\theta|D)$, followed by EXECUTE: controlling the hearing loss signal processor to process the audio signal with the signal processing algorithm $F(\hat{\theta})$ applying the set $\hat{\theta}$ of signal processing parameters for user evaluation of the first hearing loss compensated audio signal, and RATE: user entry of consent or dissent, and ADAPT: use Bayes rule to include the most recent response d in a preference model, e.g. in the preference probability distribution $p(\theta|D)$, e.g. by calculation of a posterior distribution $\mathcal{N}(\tilde{\mu}, \tilde{\Sigma})$ of the utility parameters co with mean $\tilde{\mu}$ and covariance matrix $\tilde{\Sigma}$:

$$p(\omega|D,d) \propto p(d|\omega) \cdot p(\omega|D)$$

wherein d indicates user consent or user dissent, respectively, and $$p(d \mid \omega) = \frac{1}{1 + e^{-\lambda(2d-1)(U_a - U_r)}} = g(\lambda(2d-1)(U_a - U_r)),$$

and $g(x)=1/(1+e^{-x})$ and $U_a=U(\theta_a,\omega)$ and $U_r=U(\theta_r,\omega)$ relate to utility values for alternative $\theta_a$ and reference $\theta_r$ hearing aid parameter values, respectively.

The user response d may be provided in various ways and the DETECT and RATE steps may be performed in various ways.

For example, the user response variable d may be a binary variable, e.g. d=1 when the user has entered a consent input, and d=0 when the user has entered a dissent input, and the user may enter a dissent input by refraining from entering an input for a specific period of time.

In this way, the burden of user input to the hearing aid system is minimized to one input to start the process of improving the setting of signal processing parameters of the hearing aid, and one input of consent, when the user is satisfied with the setting suggested by the adjustment processor.

In another example, the user response variable is an integer with a value entered by the user to indicate user perceived sound quality, e.g. d=5 for "very good", d=4 for "good", d=3 for "acceptable", d=2 for "bad", and d=1 for "very bad" and thus, the user enters an input during each EXECUTE STEP.

The person skilled in the art will be able to design numerous other ways of user interaction with the hearing loss processor and the adjustment processor in order to perform in-situ fitting of the hearing aid.

The Adjustment Processor

The adjustment processor may be distributed between a plurality of processors, e.g. residing in separate devices, interconnected and cooperating for provision of the adjustment processor. For example, the adjustment processor, or, part of the adjustment processor may reside on a server interconnected with other parts of the hearing aid system through a network, such as the internet. For example, one or more servers may reside in a cloud computing network and/or in a grid computing network and/or another form of computing network, interconnected and cooperating with other parts of the hearing aid system for provision of computing and/or memory and/or database resources for proper functioning of the hearing aid system.

The adjustment of the set $\theta$ of signal processing parameters is performed during normal use of the first hearing aid, i.e. while the first hearing aid is worn in its intended position at the ear of a user and performing hearing loss compensation in accordance with the individual hearing loss of the respective user wearing the first hearing aid. The adjustment is performed in response to user input D relating to how well the user is satisfied with the sound currently emitted by the first hearing aid worn by the user.

Binaural Hearing Aid

The hearing aid system may comprise a binaural hearing aid system with two hearing aids, one for the right ear and one for the left ear of the user of the hearing aid system.

Thus, in addition to the first hearing aid, the hearing aid system may comprise a second hearing aid with a second microphone for provision of a second audio input signal in response to sound signals received at the second microphone, a second hearing loss signal processor that is adapted to process the second audio signal in accordance with a signal processing algorithm F(θ), where θ is a set of signal processing parameters of the signal processing algorithm F, to generate a second hearing loss compensated audio signal for compensation of a hearing loss of a user of the hearing aid system, a second output transducer for providing a second acoustic output signal based on the second hearing loss compensated audio signal, and a second interface adapted for data communication with one or more other devices.

The circuitry of the second hearing aid is preferably identical to the circuitry of the first hearing aid apart from the fact that the second hearing aid, typically, is adjusted to compensate a hearing loss that is different from the hearing loss compensated by the first hearing aid, since; typically, binaural hearing loss differs for the two ears of the user of the hearing aid system.

The adjustment processor may be adapted for calculating values of signal processing parameters of signal processing algorithms of the second hearing loss signal processor and for controlling the second hearing loss signal processor to process the second audio signal with the signal processing algorithm with the calculated values of the signal processing parameters in the same way as explained above with relation to the first hearing loss signal processor.

In binaural hearing aid systems, it is important that the signal processing algorithms of the first and second hearing loss signal processors are selected in a coordinated way. Since sound environment characteristics may differ significantly at the two ears of a user, it will often occur that independent determination of category of the sound environment at the two ears of a user differs, and this may lead to undesired different signal processing of sounds in the first and second hearing aids. Thus, preferably the adjustment processor is adapted to repeat the steps of calculating a set $\hat{\theta}1$ of signal processing parameters of the first hearing aid, and a set $\hat{\theta}2$ of signal processing parameters of the second hearing aid, and controlling the first hearing loss signal processor to process the first audio signal with the signal processing algorithm F1($\hat{\theta}1$) with the set $\hat{\theta}1$ of signal processing parameters and the second hearing loss signal processor to process the second audio signal with the signal processing algorithm F2($\hat{\theta}2$) with the set $\hat{\theta}2$ of signal processing parameters for user evaluation of the first and second hearing loss compensated audio signals, e.g. for the specific period of time, until the steps of calculating and controlling have been performed a specific maximum number of times, e.g. 2, 3, 4, 5, 6, 7, 8, 9, 10, etc., times, preferably more than 4 times, preferred 10 times; or, until the user has entered a consent input using the user interface.

The maximum number of times may be adjustable.

The specific period of time for user evaluation may last for 2 to 10 seconds, preferably for 5 seconds.

The specific period of time for user evaluation may be adjustable.

Other Device

The hearing aid system may comprise another device, preferably a wearable device, such as a smartwatch, an activity tracker, a mobile phone, a smartphone, a tablet computer, etc., that is communicatively coupled with the hearing aid(s) of the hearing aid system. The device may for example communicate with the hearing aid(s) of the hearing aid system through a Bluetooth network, such as a Bluetooth LE network, in a way well-known in the art of hearing aids. In this way, the hearing aid system is provided with the further communication resources and computing capabilities of the device.

Preferably, the device comprises the user interface; or, a part of the user interface used to enter the dissent input and the consent input. For example, the device may be a smartwatch adapted to display a specific icon to be touched for entry of the dissent input and display another specific icon to be touched for entry of the consent input.

The device may comprise the adjustment processor.

The hearing aid system may comprise a plurality of other devices, such as a smartphone and a smartwatch that are interconnected as is well-known in the art. In such a hearing aid system, the smartwatch may comprise the user interface; or, a part of the user interface used to enter the dissent input and the consent input, and the smartphone may comprise the adjustment processor.

Connectivity of Devices of the Hearing Aid System

Devices of the hearing aid system may transmit data to each other and receive data from each other through a wired or wireless network with their respective communication interfaces. Examples of the network may include the Internet, a local area network (LAN), a wireless LAN, a wide area network (WAN), and a personal area network (PAN), either alone or in any combination. However, the network may include, or be constituted by, another type of network.

Hearing Aid Connectivity

The hearing aid system may comprise a hearing aid with an interface for connection with a Wide-Area-Network, such as the Internet.

The hearing aid system may have a hearing aid that accesses the Wide-Area-Network through a mobile telephone network, such as GSM, IS-95, UMTS, CDMA-2000, etc.

The hearing aid system may have a hearing aid comprising an interface for transmission of data and/or control signals between the hearing aid and the one or more other devices and, optionally, other parts of the hearing aid system, e.g. including another hearing aid of the hearing aid system.

The interface may be a wired interface, e.g. a USB interface, or a wireless interface, such as a Bluetooth interface, e.g. a Bluetooth Low Energy interface.

The hearing aid may comprise an audio interface for reception of an audio signal from the hand-held device and possibly other audio signal sources.

The audio interface may be a wired interface or a wireless interface. The interface and the audio interface may be combined into a single interface, e.g. a USB interface, a Bluetooth interface, etc.

The hearing aid may for example have a Bluetooth Low Energy interface for exchange of sensor and control signals between the hearing aid and the one or more other devices, and a wired audio interface for exchange of audio signals between the hearing aid and one or more of the other devices.

Other Device Connectivity

Each of the one or more other devices may have an interface for connection with the wired or wireless network through which the device in question may perform data communication. As mentioned above, examples of the network may include the Internet, a local area network (LAN), a wireless LAN, a wide area network (WAN), and a personal area network (PAN), either alone or in any combination. However, the network may include, or be constituted by, another type of network.

The interface may access the network through a mobile telephone network, such as GSM, IS-95, UMTS, CDMA-2000, etc.

Through the network, e.g. the Internet, the one or more devices may have access to electronic time management and communication tools used by the user for communication and for storage of time management and communication information relating to the user. The tools and the stored information typically reside on a remote at least one server accessed through the network.

Location Detector

The first hearing aid may comprise a location detector adapted for determining a geographical position of the hearing aid and the adjustment processor may be adapted to include the geographical position of the hearing aid in the utility model $U(\theta,\omega)$ and/or in the preference probability distribution $p(\theta|D)$. Different utility models may be provided for different geographical positions, and Bayesian model averaging may be performed.

At least one of the other devices of the hearing aid system may comprise a location detector adapted for determining a geographical position of the hearing aid system and the adjustment processor may be adapted to include the geographical position in the utility model $U(\theta, \omega)$ and/or in the preference probability distribution $p(\theta|D)$.

The location detector when residing in another device benefits from the larger computing resources and power supply typically available in the other device as compared with the limited computing resources and power available in the hearing aid.

The location detector may include at least one of a GPS receiver, a calendar system, a WIFI network interface, a mobile phone network interface, for determining the geographical position of the hearing aid system and optionally the velocity of the hearing aid system.

In absence of useful GPS signals, the location detector may determine the geographical position of the hearing aid system based on the postal address of a WIFI network the hearing aid system may be connected to, or by triangulation based on signals possibly received from various GSM-transmitters as is well-known in the art of mobile phones. Further, the location detector may be adapted for accessing a calendar system of the user to obtain information on the expected whereabouts of the user, e.g. meeting room, office, canteen, restaurant, home, etc. and to include this information in the determination of the geographical position. Thus, Information from the calendar system of the user may substitute or supplement information on the geographical position determined by otherwise, e.g. by a GPS receiver.

The location detector may automatically use information from the calendar system, when the geographical position cannot be determined otherwise, e.g. when the GPS-receiver is unable to provide the geographical position.

Sound Environment Detector

The hearing aid system may have a sound environment detector adapted for determination of the sound environment surrounding the hearing aid system based on sound signals received by the hearing aid system, e.g. from the first hearing aid of the hearing aid system; or, from two hearing aids of the hearing aid system, as is well-known in the art of hearing aids. For example, the sound environment detector may determine a category of the sound environment surrounding the respective hearing aid, such as speech, babble speech, restaurant clatter, music, traffic noise, etc.

The first hearing aid of the hearing aid system may comprise the sound environment detector; or a part of the sound environment detector.

One of the other devices may comprise the sound environment detector of the hearing aid system. The sound environment detector residing in the other device benefits from the larger computing resources and power supply typically available in the other device as compared with the limited computing resources and power available in the hearing aid.

The adjustment processor may be adapted for calculation of the set $\theta$ of signal processing parameters based on the category of the sound environment of the hearing aid system determined by the sound environment detector, and for transmission of the set $\hat{\theta}$ of signal processing parameters to the hearing aid(s) of the hearing aid system.

The sound environment detector may be adapted for including the geographical position of the hearing aid system as determined by the location detector in its determination of the sound environment.

The sound environment at a specific geographical position, such as a city square, may change in a repetitive way during the year in a similar way from one year to another and/or during a day in a similar way from one day to another, e.g. due to repeated variations in traffic, number of people, etc., and such variations may be taken into account by allowing the sound environment detector to include the date and/or the time of day in the determining the category of sound environment.

For a hearing aid system with a binaural hearing aid, the sound environment detector may be adapted for determining the category of the sound environment surrounding the user of the hearing aid system based on the sound signals received at both hearing aids and optionally the geographical position of the hearing aid system.

The adjustment processor may be adapted to include the sound environment as determined by the sound environment detector in the utility model $U(\theta, \omega)$ and/or in the preference probability distribution $p(\theta|D)$, for example, the adjustment processor may include the sound environment detector.

User Interface

The first hearing aid may comprise a user interface allowing a user of the hearing aid system to make adjustment of one or more of the signal processing parameters of the set $\theta$ of the signal processing parameters.

The hearing aid system may have another device that is interconnected with the first hearing aid and that comprises a user interface allowing a user of the hearing aid system to make adjustment of values of one or more of the signal processing parameters of the set $\theta$ of the signal processing parameters. The user interface residing in the other device benefits from the larger computing resources and power supply typically available in the other device as compared with the limited computing resources and power available in the first hearing aid.

The user may not be satisfied with the automatic selection of parameter values performed by the at least one server and may perform an adjustment of signal processing parameters using the user interface, e.g. the user may change the current selection of signal processing algorithm to another signal processing algorithm, e.g. the user may switch from a directional signal processing algorithm to an omni-directional signal processing algorithm; or, the user may adjust a parameter, e.g. the volume.

The adjustment processor may be adapted to include user adjustments in the utility model $U(\theta, \omega)$ and/or in the preference probability distribution $p(\theta|D)$.

In this way, the hearing aid system makes it possible to effectively learn a complex relationship between desired adjustments of signal processing parameters relating to various listening conditions and corrective user adjustments that are a personal, time-varying, nonlinear, and stochastic.

Types of Hearing Aids

The hearing aid may be of any type adapted to be head worn at, and shifting position and orientation together with, the head, such as a BTE, a RIE, an ITE, an ITC, a CIC, etc., hearing aid.

GPS

Throughout the present disclosure, the term GPS receiver is used to designate a receiver of satellite signals of any satellite navigation system that provides location and time information anywhere on or near the Earth, such as the satellite navigation system maintained by the United States government and freely accessible to anyone with a GPS receiver and typically designated "the GPS-system", the Russian GLObal NAvigation Satellite System (GLONASS), the European Union Galileo navigation system, the Chinese Compass navigation system, the Indian Regional Navigational 20 Satellite System, etc., and also including augmented GPS, such as StarFire, Omnistar, the Indian GPS Aided Geo Augmented Navigation (GAGAN), the European Geostationary Navigation Overlay Service (EGNOS), the Japanese Multifunctional Satellite Augmentation System (MSAS), etc. In augmented GPS, a network of ground-based reference stations measure small variations in the GPS satellites' signals, correction messages are sent to the GPS system satellites that broadcast the correction messages back to Earth, where augmented GPS-enabled receivers use the corrections while computing their positions to improve accuracy. The International Civil Aviation Organization (ICAO) calls this type of system a satellite-based augmentation system (SBAS).

Orientation Sensors

The hearing aid may further comprise one or more orientation sensors, such as gyroscopes, e.g. MEMS gyros, tilt sensors, roll ball switches, etc., adapted for outputting signals for determination of orientation of the head of a user wearing the hearing aid, e.g. one or more of head yaw, head pitch, head roll, or combinations hereof, e.g. inclination or tilt, and the adjustment processor may be adapted to include the orientation of the head of the user in the utility model $U(\theta, \omega)$ and/or in the preference probability distribution $p(\theta|D)$.

Calendar Systems

Throughout the present disclosure, a calendar system is a system that provides users with an electronic version of a calendar with data that can be accessed through a network, such as the Internet. Well-known calendar systems include, e.g., Mozilla Sunbird, Windows Live Calendar, Google Calendar, Microsoft Outlook with Exchange Server, etc., and the adjustment processor may be adapted to include information from the calendar system in the utility model $U(\theta, \omega)$ and/or in the preference probability distribution $p(\theta|D)$.

Signal Processing Library and Parameters

The signal processing algorithm $F(\theta)$ may comprise a plurality of sub-algorithms or sub-routines that each performs a particular subtask in the signal processing algorithm $F(\theta)$. As an example, the signal processing algorithm $F(\theta)$ may comprise different signal processing sub-routines such as frequency selective filtering, single or multi-channel compression, adaptive feedback cancellation, speech detection and noise reduction, etc.

Furthermore, several distinct selections of signal processing sub-algorithms or sub-routines may be grouped together to form two, three, four, five or more different pre-set listening programs which the user may be able to select between in accordance with his/hers preferences.

The signal processing sub-algorithms will have one or several related algorithm parameters. These algorithm parameters can usually be divided into a number of smaller parameters sets, where each such algorithm parameter set is related to a particular part of the signal processing algorithm $F(\theta)$. These parameter sets control certain characteristics of their respective sub-algorithms or subroutines such as corner-frequencies and slopes of filters, compression thresholds and ratios of compressor algorithms, filter coefficients, including adaptive filter coefficients, adaptation rates and probe signal characteristics of adaptive feedback cancellation algorithms, etc.

Values of the algorithm parameters are preferably intermediately stored in a volatile data memory area of the processing means such as a data RAM area during execution of the respective signal processing algorithms or sub-routines. Initial values of the algorithm parameters are stored in a non-volatile memory area such as an EEPROM/Flash memory area or battery backed-up RAM memory area to allow these algorithm parameters to be retained during power supply interruptions, usually caused by the user's removal or replacement of the hearing aid's battery or manipulation of an ON/OFF switch.

Signal Processing Implementations

Signal processing in the new hearing aid system may be performed by dedicated hardware or may be performed in a signal processor, or performed in a combination of dedicated hardware and one or more signal processors.

As used herein, the terms "processor", "signal processor", "controller", "system", etc., are intended to refer to CPU-related entities, either hardware, a combination of hardware and software, software, or software in execution.

For example, a "processor", "signal processor", "controller", "system", etc., may be, but is not limited to being, a process running on a processor, a processor, an object, an executable file, a thread of execution, and/or a program.

By way of illustration, the terms "processor", "signal processor", "controller", "system", etc., designate both an application running on a processor and a hardware processor. One or more "processors", "signal processors", "controllers", "systems" and the like, or any combination hereof, may reside within a process and/or thread of execution, and one or more "processors", "signal processors", "controllers", "systems", etc., or any combination hereof, may be localized on one hardware processor, possibly in combination with other hardware circuitry, and/or distributed between two or more hardware processors, possibly in combination with other hardware circuitry.

Also, a processor (or similar terms) may be any component or any combination of components that is capable of performing signal processing. For examples, the signal processor may be an ASIC processor, a FPGA processor, a general purpose processor, a microprocessor, a circuit component, or an integrated circuit.

A hearing aid system includes: a first hearing aid with a first microphone for provision of a first audio signal in response to sound signals received at the first microphone from a sound environment, a first hearing loss signal processor that is configured to process the first audio signal in accordance with a signal processing algorithm to generate a first hearing loss compensated audio signal for compensation of a hearing loss of a user of the hearing aid system, wherein the signal processing algorithm F is configured to apply a first set of signal processing parameters, a first output transducer for providing a first output signal to a user of the hearing aid system based on the first hearing loss compensated audio signal, and a first interface configured for data communication with one or more other device(s); a user interface; and an adjustment processor that is configured for calculating a second set of signal processing parameters comprising alternate value(s) for one or more of the signal processing parameters in the first set, and controlling the first hearing loss signal processor to process the first audio signal with the signal processing algorithm applying the second set of signal processing parameters for evaluation of the first hearing loss compensated audio signal.

Optionally, the adjustment processor is configured to repeat the functions of calculating the second set of the signal processing parameters, and controlling the first hearing loss signal processor to process the first audio signal with the signal processing algorithm applying the second set of the signal processing parameters.

Optionally, the adjustment processor is configured to repeat the functions of calculating the second set of the signal processing parameters, and controlling the first hearing loss signal processor, when a predetermined time period has elapsed until a predetermined number of repetitions have been performed.

Optionally, the adjustment processor is configured to update a utility model U defined as $U=\omega^T b$ wherein b is a K-dimensional set of basis functions, and wherein co is a K-dimensional vector comprising utility parameters for the utility model.

Optionally, the adjustment processor is configured to calculate the second set of the signal processing parameters by Thompson sampling of the second set of signal processing parameters from a preference probability distribution p given by:

$$p = \frac{1}{Z} e^{\gamma \cdot EU},$$

wherein Cu is an expected utility, $\gamma$ is a scaling parameter, and Z is obtained from a normalization condition.

Optionally, the adjustment processor is configured to use Bayes rule to include the most recent response d in a preference probability distribution.

Optionally, the preference probability distribution is $p(\theta|D)$, and wherein the adjustment processor is configured to use Bayes rule to include the most recent response d in the preference probability distribution $p(\theta|D)$ by calculation of a posterior distribution $\mathcal{N}(\tilde{\mu}, \tilde{\Sigma})$ of utility parameters $\omega$ with mean $\tilde{\mu}$ and covariance matrix $\tilde{\Sigma}$ based on the following: $p(\omega|D,d) \propto p(d|\omega)$—$p(\omega|D)$, wherein D relates to observed data, d indicates user consent or user dissent, $$p(d \mid \omega) = \frac{1}{1 + e^{-\lambda(2d-1)(U_a - U_r)}} = g(\lambda(2d-1)(U_a - U_r)),$$

$g(x)=1/(1+e^{-x})$, $U_a=U(\theta_a, \omega)$, $U_r=U(\theta_r, \omega)$, $\theta_a$ represents alternative hearing aid parameter values, and $\theta_r$ represents reference hearing aid parameter values.

Optionally, the adjustment processor is configured to perform a Laplace approximation to obtain a distribution of the utility parameters $\omega$ by updating $(\mu, \Sigma)$ to $(\tilde{\mu}, \tilde{\Sigma})$:

$$\tilde{\Sigma} = \Sigma - \frac{\hat{d}(1-\hat{d})}{\lambda^{-2} + \hat{d}(1-\hat{d})(\tilde{b}^T \Sigma \tilde{b})} (\Sigma \tilde{b})(\Sigma \tilde{b})^T$$

$$\tilde{\mu} = \mu + \lambda(d - \hat{d})\tilde{\Sigma}\tilde{b}$$

wherein $\tilde{b}=b(\theta_a)-b(\theta_r)$, $\hat{d}=g(\lambda\omega^T\tilde{b})$, and $p(\omega|D)=\mathcal{N}(\mu, \Sigma)$ with mean $\mu$ and covariance matrix $\Sigma$.

Optionally, the hearing aid system further includes a wearable device with a data interface that is configured for data communication with the first hearing aid; wherein the user interface that is configured for entry of a dissent input or a consent input by the user.

Optionally, the adjustment processor is configured to transmit control signals to the first hearing aid using the data interface for controlling the first hearing loss signal processor to process the first audio signal with the signal processing algorithm applying the second set of the signal processing parameters.

Optionally, the hearing aid system further includes a sound environment detector configured for determining a category of the sound environment surrounding the hearing aid system; wherein the adjustment processor is configured for calculating the second set of the signal processing parameters of the first hearing aid of the hearing aid system based on the category of the sound environment determined by the sound environment detector.

Optionally, the hearing aid system further includes a location detector configured for determining a geographical position of the hearing aid system; wherein the adjustment processor is configured for calculating the second set of the signal processing parameters of the first hearing aid of the hearing aid system based the geographical position of the hearing aid system.

Optionally, the user interface is configured for allowing the user of the hearing aid system to adjust at least one of the signal processing parameters in the first set; wherein the adjustment processor is configured for recording of the adjustment of the at least one of the signal processing parameters made by the user of the hearing aid system, and incorporating the adjustment made by the user in a preference probability distribution.

Optionally, the first hearing loss signal processor comprises the adjustment processor.

A method of in-situ fitting of a hearing aid, the hearing aid having a microphone for provision of an audio signal in response to sound signals received at the microphone from a sound environment, a hearing loss signal processor that is configured to process the audio signal in accordance with a signal processing algorithm to generate a first hearing loss compensated audio signal for compensation of a hearing loss of a user of the hearing aid system, the signal processing algorithm configured to apply a first set of signal processing parameters, and a first output transducer for providing a first output signal based on the first hearing loss compensated audio signal, the method includes: calculating a second set of signal processing parameters having alternate value(s) for one or more of the signal processing parameters in the first set; and controlling the hearing loss signal processor to process the audio signal with the signal processing algorithm applying the second set of the signal processing parameters for evaluation of the first hearing loss compensated audio signal.

Other features, advantageous, and embodiments will be described in the detailed description.

BRIEF DESCRIPTION OF THE DRAWINGS

The drawings illustrate the design and utility of embodiments, in which similar elements are referred to by common reference numerals. These drawings are not necessarily drawn to scale. In order to better appreciate how the above-recited and other advantages and objects are obtained, a more particular description of the embodiments will be rendered, which are illustrated in the accompanying drawings. These drawings depict only typical embodiments and are not therefore to be considered limiting of its scope.

DETAILED DESCRIPTION

Figure 1:
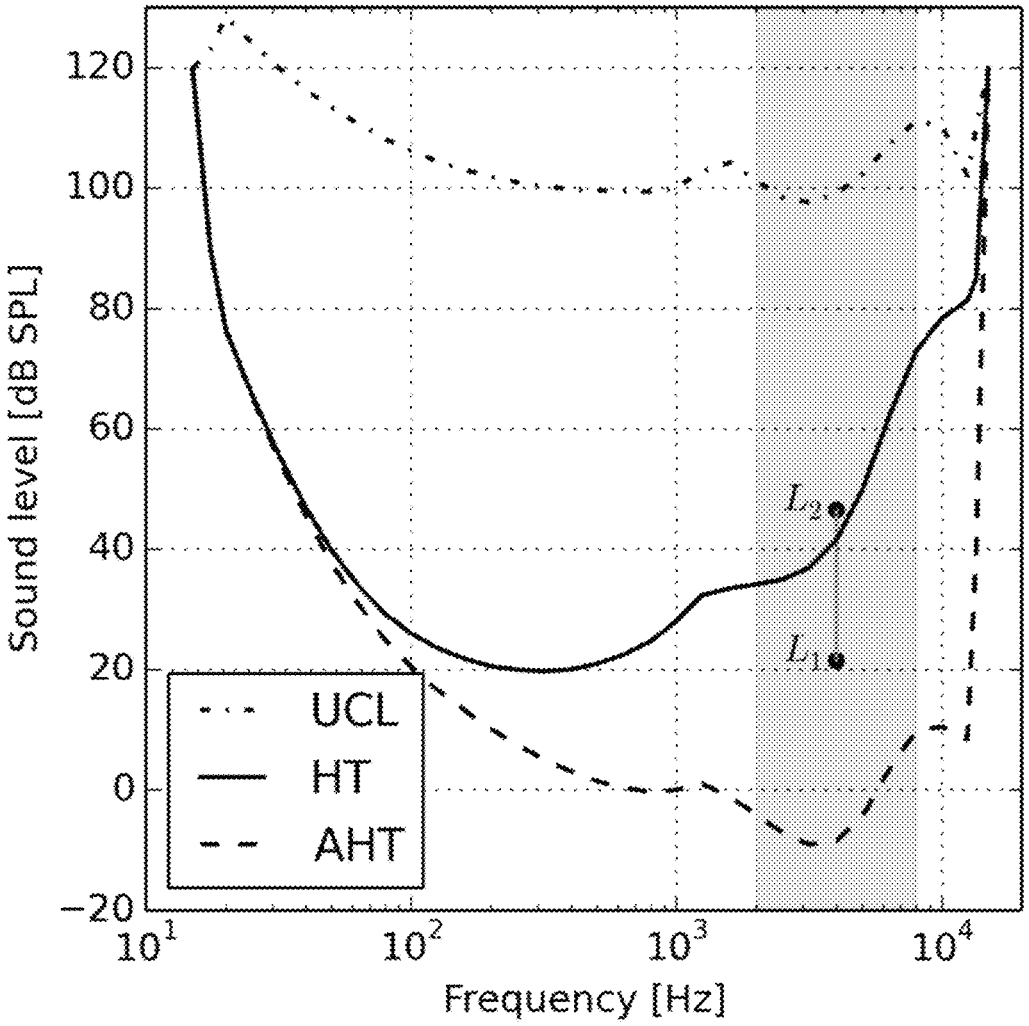
FIG. 1 is a plot of hearing thresholds.

Various exemplary embodiments are described hereinafter with reference to the figures. It should be noted that the figures are not drawn to scale and that elements of similar structures or functions are represented by like reference numerals throughout the figures. It should also be noted that the figures are only intended to facilitate the description of the embodiments. They are not intended as an exhaustive description of the claimed invention or as a limitation on the scope of the claimed invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or not so explicitly described.

The hearing aid system will now be described more fully hereinafter with reference to the accompanying drawings, in which various types of the hearing aid system are shown. The hearing aid system may be embodied in different forms not shown in the accompanying drawings and should not be construed as limited to the embodiments and examples set forth herein.

FIG. 3

Figure 3:
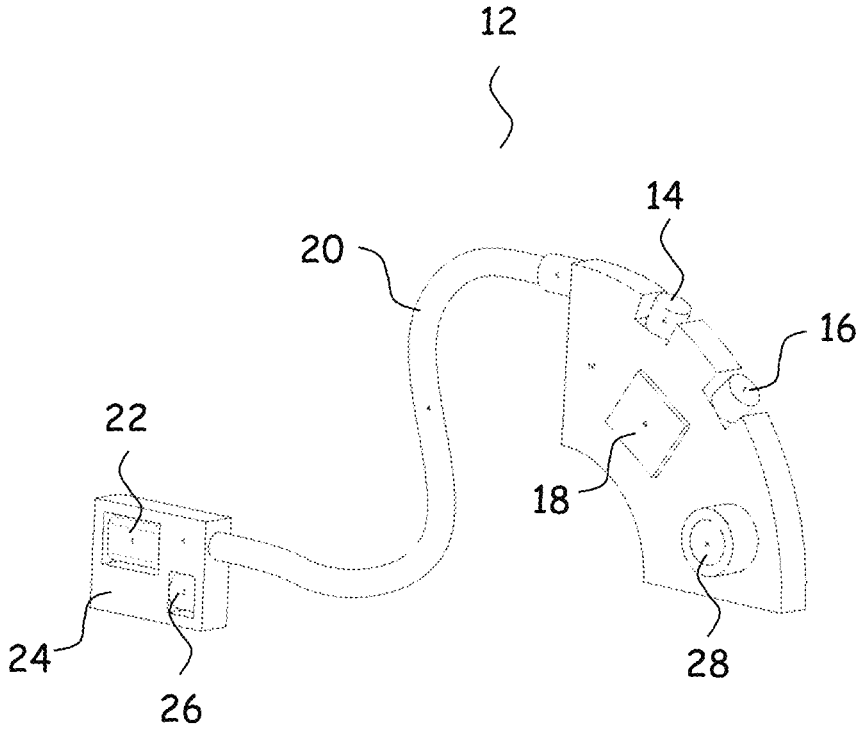

FIG. 3 schematically illustrates an exemplary hearing aid 12 of the hearing aid system, namely a BTE hearing aid 12 comprising a BTE hearing aid housing (not shown—outer walls have been removed to make internal parts visible) to be worn behind the pinna of a user. The BTE housing (not shown) accommodates a front microphone 14 and a rear microphone 16 for conversion of a sound signal into a microphone audio sound signal, optional pre-filters (not shown) for filtering the respective microphone audio sound signals, A/D converters (not shown) for conversion of the respective microphone audio sound signals into respective digital microphone audio sound signals that are input to a hearing loss signal processor 18 adapted to generate a hearing loss compensated output signal based on the input digital audio sound signals.

The hearing loss compensated output signal is transmitted through electrical wires contained in a sound signal transmission member 20 to a receiver 22 for conversion of the hearing loss compensated output signal to an acoustic output signal for transmission towards the eardrum of a user and contained in an earpiece 24 that is shaped (not shown) to be comfortably positioned in the ear canal of a user for fastening and retaining the sound signal transmission member in its intended position in the ear canal of the user as is well-known in the art of BTE hearing aids.

The earpiece 24 also holds one microphone 26 that is positioned for abutment of a wall of the ear canal when the earpiece is positioned in its intended position in the ear canal of the user for reception of the user's own voice utilizing bone conduction of the voice to the microphone 26. The microphone 26 is connected to an A/D converter (not shown) and optional to a pre-filter (not shown) in the BTE housing 12, with interconnecting electrical wires (not visible) contained in the sound transmission member 20.

The BTE hearing aid 12 is powered by battery 28.

The hearing loss signal processor 18 is adapted for execution of a number of different signal processing algorithms of a library of signal processing algorithms $F(\theta)$ stored in a non-volatile memory (not shown) connected to the hearing loss signal processor 18. Each signal processing algorithm $F(\theta)$, or a combination of them, is tailored to particular user preferences and particular categories of sound environment. $\theta$ is the set of signal processing parameters of the signal processing algorithm F.

Initial settings of signal processing parameters of the various signal processing algorithms are typically determined during an initial fitting session in a dispenser's office and programmed into the hearing aid by activating desired algorithms and setting algorithm parameters in a non-volatile memory area of the hearing aid and/or transmitting desired algorithms and algorithm parameter settings to the non-volatile memory area. Subsequently, the hearing aid system comprising the hearing aid 12 shown in FIG. 3, as further illustrated below, is adapted for automatic adjustment of at least one signal processing parameter $\theta_i''$ of $\theta$ in the hearing aid 12 with the library of signal processing algorithms $F(\theta)$.

Various functions of the hearing loss signal processor 18 are disclosed above and in more detail below.

FIG. 4

Figure 4:
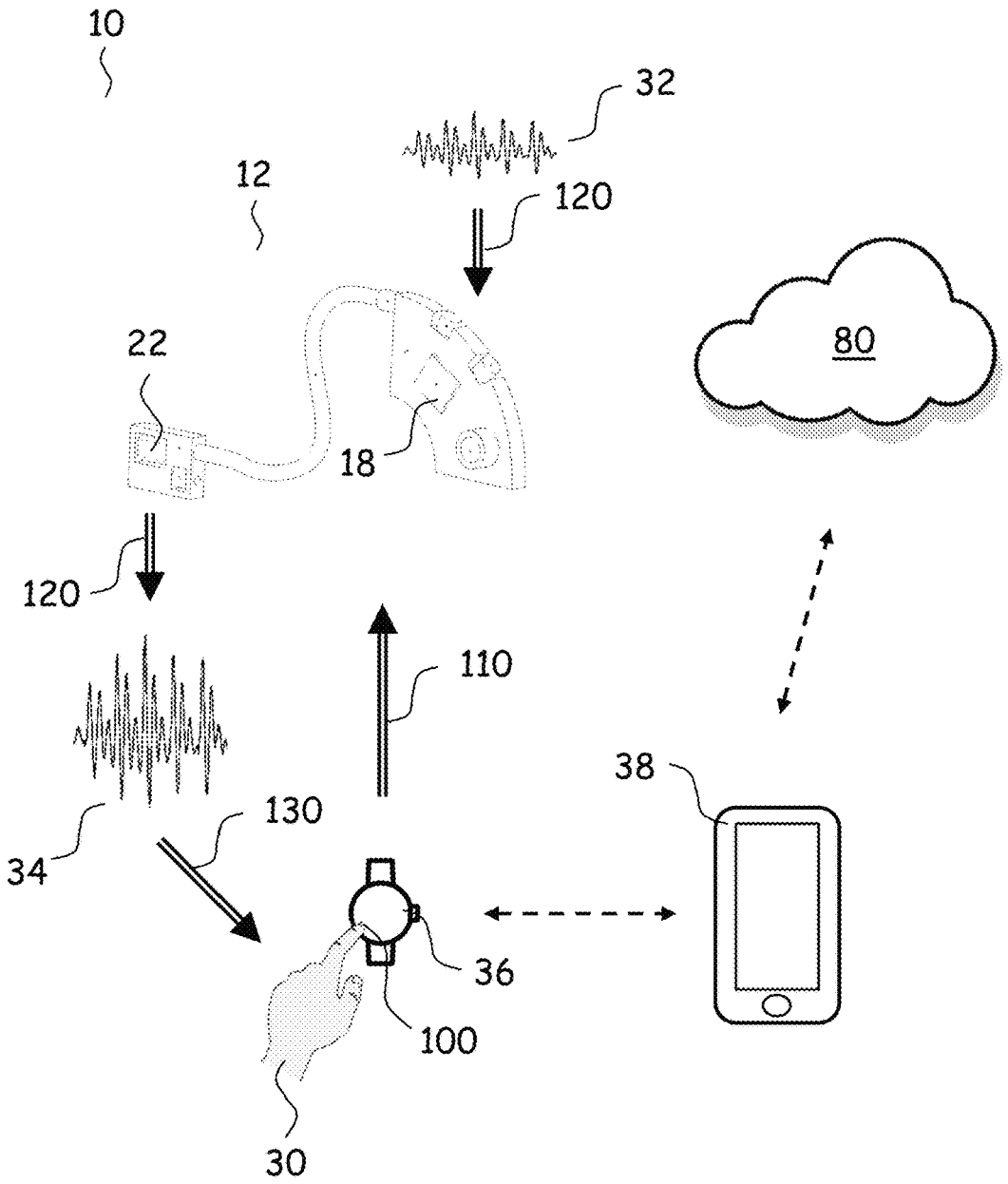

FIG. 4 schematically illustrates a hearing aid system 10 with the hearing aid 12, wherein the hearing aid system 10 is adapted for adjusting signal processing parameters $\theta$ used in the hearing loss signal processor 18 of the hearing aid 12 during normal use of the hearing aid system 10, i.e. while the hearing aid system 10 is worn by a user 30 and provides hearing loss compensated sound signals 34 to the user 30.

FIG. 4 schematically shows the hearing aid 12 of FIG. 3, with the hearing loss signal processor 18 that executes a digital signal processing (DSP) algorithm $F(\theta)$ to process an audio signal schematically illustrated at 32 thereby producing a hearing loss compensated output signal schematically illustrated at 34. The DSP algorithm $F(\theta)$ is executed with a set $\theta$ of signal processing parameters that are set to values which in the following are referred to as reference values. The user 30 listens to the hearing loss compensated output signal 34 converted into an acoustic output signal by the receiver 22. A scanning process of searching for other signal processing parameters commences whenever the user 30 decides to try to improve the hearing loss compensation currently performed by the hearing aid 12. In the following, one iteration of the scanning process is called a trial.

The operation of the illustrated hearing aid system 10 includes the following steps:

DETECT 100: Whenever the user 30 perceives that the sound 34 output by the hearing aid 12 could or should be improved, the user 30 can initiate a trial by entering a dissent input, e.g. by touching a specific icon on a touch screen of a smartwatch 36 or a smartphone 38, etc.

TRY 110: After reception of the dissent input, a computational process called the TRY step is executed on the smartwatch 36, wherein the adjustment processor, in this example residing in the smartwatch 36, calculates a set $\hat{\theta}$ of signal processing parameters. Next, the smartwatch 36 sends the set $\hat{\theta}$ of signal processing parameters to the hearing aid device 12.

EXECUTE 120. The hearing aid device 12 receives the set $\hat{\theta}$ of signal processing parameters and the hearing loss signal processor 18 executes the digital signal processing (DSP) algorithm $F(\theta)$ with the set $\hat{\theta}$ of signal processing parameters for provision of the hearing loss compensated output signal 34 based on the audio input signal 32.

RATE 130. The user 30 now listens to the sound 34 that is generated by the digital signal processing (DSP) algorithm $F(\theta)$ with the set $\hat{\theta}$ of signal processing parameters and evaluates the perceived quality of the sound resulting from the change to the set $\hat{\theta}$ of signal processing parameters. In the event that the user 30 decides to continue the scanning process, the user 30 does nothing, i.e. the user 30 does not enter a consent input using the touchscreen of the smartwatch 36 or the smartphone 38. When the user 30 has not entered a consent input for a predetermined time period, which in this example is 5 seconds, this is considered to constitute entry of a dissent input by the hearing aid system 10, and another trial will be performed. In the event that the user 30 perceives the evaluated sound to be of such a quality that the user desires that the hearing loss signal processor 18 continues processing sound with the set $\hat{\theta}$ of signal processing parameters, the user touches a "consent" icon on the touchscreen of the smartwatch 36 or the smartphone 38 thereby entering a consent input.

Upon receipt of the consent input, no further trials will be performed, until a new dissent input is entered, and the hearing loss signal processor continues operation with the latest set $\hat{\theta}$ of signal processing parameters.

ADAPT 140. Further, the adjustment processor is adapted to learn from the user preferences input in the form of consent and dissent inputs, i.e. the adjustment processor may base subsequent calculations of sets $\hat{\theta}$ of signal processing parameters on the set of signal processing parameters used by the hearing loss signal processor 18 when a consent input is entered. In this way, a set $\hat{\theta}$ of signal processing parameters accepted for use by the user is reached with a minimum number of trials.

As explained previously, Bayes rule may be used to include the most recent response d in the preference probability distribution by calculation of:

$$p(\omega|D,d) \propto p(d|\omega) \cdot p(\omega|D)$$

The posterior Gaussian distribution of the utility parameters, i.e. the Gaussian distribution of the utility parameters after inclusion of the most recent response d, may be parameterized by mean $\tilde{\mu}$ and covariance matrix $\tilde{\Sigma}$:

$$p(\omega|D) = \mathcal{N}(\mu, \Sigma),$$

Bayes rule as applied above involves multiplication of a Gaussian distribution with a logistic function, which does not lead analytically to a Gaussian distribution for the resulting posterior distribution $p(\omega|D,d)$.

However, the procedure denoted "Laplace approximation" may be used to create a Gaussian posterior distribution for the utility parameters.

The Laplace approximation leads to the following update rule for updating $(\mu, \Sigma)$ to $(\tilde{\mu}, \tilde{\Sigma})$:

$$\tilde{\Sigma} = \Sigma - \frac{\hat{d}(1-\hat{d})}{\lambda^{-2} + \hat{d}(1-\hat{d})(\tilde{b}^T \Sigma \tilde{b})}(\Sigma\tilde{b})(\Sigma\tilde{b})^T$$

$$\tilde{\mu} = \mu + \lambda(d - \hat{d})\tilde{\Sigma}\tilde{b}$$

wherein $\tilde{b} = b(\theta_a) - b(\theta_r)$ and $\hat{d} = g(\lambda\omega^T\tilde{b})$.

The update rule may be carried out each time a user response d has been received.

In the event the user 30 has not entered a consent input after 10 trials, the trials will terminate and the signal processing parameters $\theta$ will be reset to the reference values, i.e. their values immediately before entry of the dissent input.

The hearing aid system 10 also comprises a hand-held device 38, in this example a smartphone, that provides the hearing aid system 10 with a network interface for interconnection of the hearing aid 12 and the smartwatch 36 of the hearing aid system 10 with a network, such as the Internet, e.g. with one or more servers on the Internet, e.g. interconnected as is well-known in the art of computer networks, such as in the art of cloud computing, grid computing, etc., whereby computing resources and database resources may be made available to the hearing aid system.

For example, the adjustment processor may be adapted to use computing resources and information stored in the cloud for its calculation of sets $\hat{\theta}$ of signal processing parameters.

For example, in the illustrated hearing aid system 10, a remote server (not shown) connected to the Internet may have access to a preference probability distribution (not shown) based on determined preference probability distributions of a plurality of users of a plurality of the hearing aid systems 10, and the adjustment processor may be adapted for calculating set $\hat{\theta}$ of signal processing parameters of the first hearing aid 12 based on the determined preference probability distribution of the user of the hearing aid system 10 and the preference probability distributions of the plurality of users.

The preference probability distribution may include at least one user parameter selected from the group consisting of the user audiogram, age, sex, race, height, and native language.

The preference probability distribution may include a hearing loss model, e.g. one of the hearing loss models mentioned in EP 2 871 858 A1.

The preference probability distribution may include various sound environment categories so that signal processing parameters determined based on the preference probability distribution may vary for different sound environment categories.

The illustrated hearing aid system 10 may have a sound environment detector 52 adapted for determination of the sound environment surrounding the hearing aid system 10 based on sound signals received by the hearing aid system 10, e.g. from one hearing aid 12A, 12B of the respective hearing aid system 10; or, from two hearing aids 12A, 12B of the respective hearing aid system 10. For example, the sound environment detector 52 may determine a category of the sound environment surrounding the respective hearing aid, such as speech, babble speech, restaurant clatter, music, traffic noise, etc.

The illustrated hearing aid system 10 may have a wearable device, in the illustrated example the smartwatch 36, and/or a hand-held device, in the illustrated example the smartphone 38, that is interconnected with the hearing aid 12 of the hearing aid system 10 and that comprises the sound environment detector 52 that is adapted for determination of the sound environment surrounding the hearing aid 12 in question. The sound environment detector 52 residing in the wearable device 36 and/or the hand-held device 38 benefits from the larger computing resources and power supply typically available in the wearable device 36 and/or hand-held device 38 as compared with the limited computing resources and power available in the hearing aid 12.

FIG. 5

Figure 2:
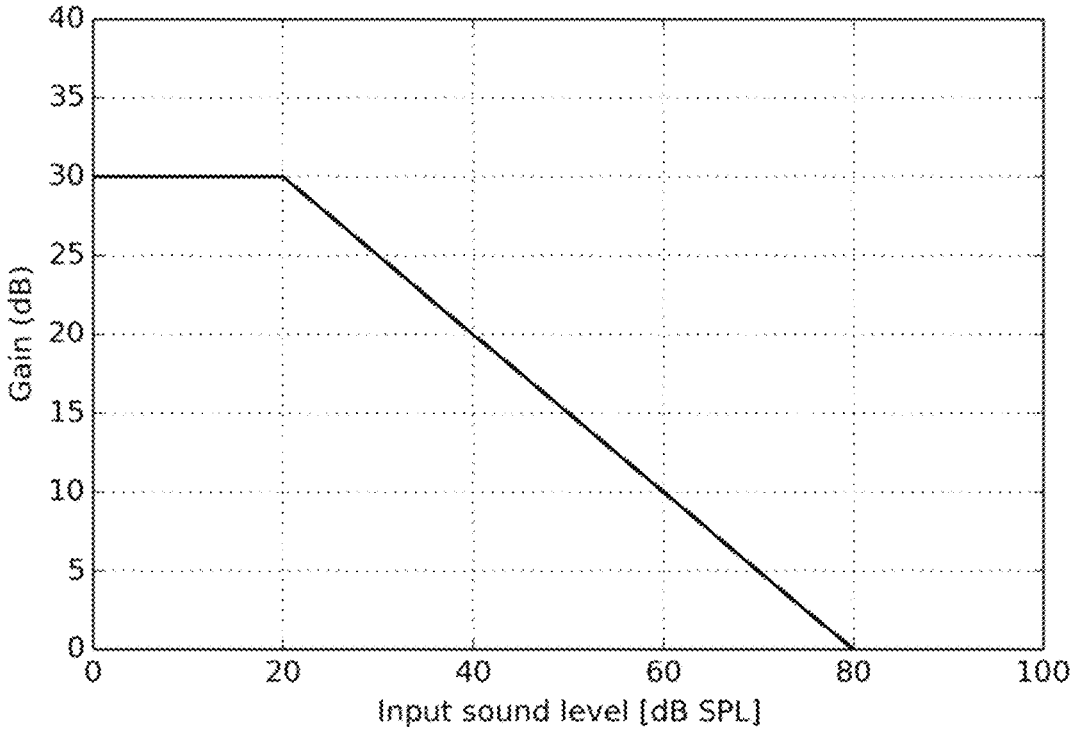
FIG. 2 is a plot of gain of a dynamic range compressor as a function of input sound pressure level in dB SPL, FIG. 3 schematically illustrates an exemplary hearing aid of the hearing aid system, FIG. 4 schematically illustrates the operation of the hearing aid system.
Figure 5:
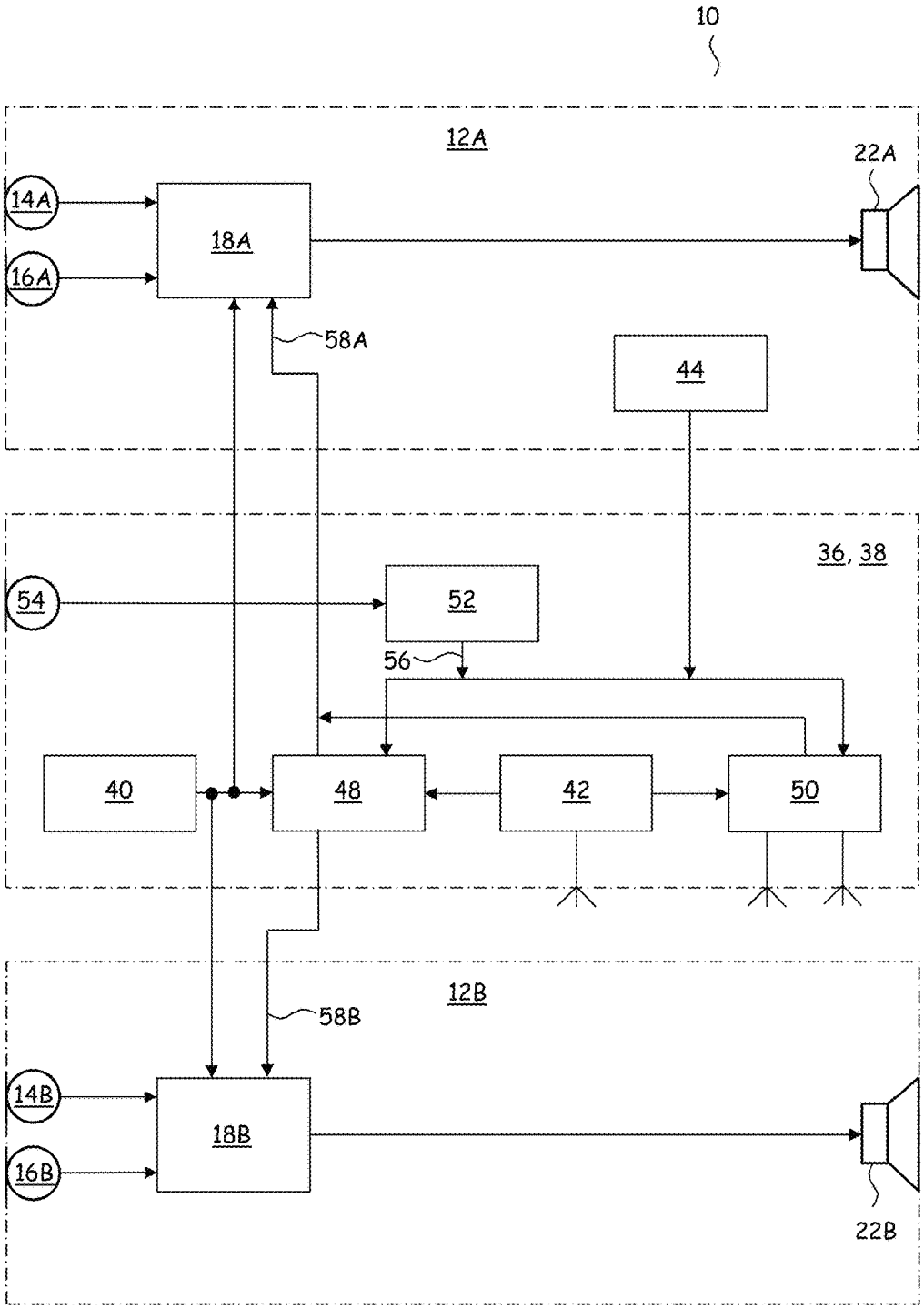
FIG. 5 shows a hearing aid system with an exemplary binaural hearing aid and a hand-held device with a GPS receiver, a sound environment detector, and a user interface.

FIG. 5 schematically illustrates components and circuitry of a hearing aid system 10 with a binaural hearing aid having a first hearing aid 12A of the type shown in FIGS. 1 and 2, e.g. for the left ear, with an orientation sensor 44, a second hearing aid 12B of the type shown in FIGS. 1 and 2, e.g. for the right ear, and a wearable or hand-held device, such as a smartwatch 36, a smartphone 38, etc., with a GPS receiver 42, a sound environment detector 52 and a user interface 40.

The hearing aids 12A, 12B may be any type of hearing aid, such as a BTE, a RIE, an ITE, an ITC, a CIC, etc., hearing aid.

Each of the illustrated hearing aids 12A, 12B comprises a front microphone 14 and a rear microphone 16 connected to respective A/D converters (not shown) for provision of respective digital input signals in response to sound signals received at the microphones 14, 16 in a sound environment surrounding the user of the hearing aid system 10. The digital input signals are input to a hearing loss signal processor 18A, 18B that is adapted to process the digital input signals in accordance with a signal processing algorithm selected from a library of signal processing algorithms F(θ) to generate a hearing loss compensated output signal. The hearing loss compensated output signal is routed to a D/A converter (not shown) and a receiver 22A, 22B for conversion of the hearing loss compensated output signal to an acoustic output signal emitted towards an eardrum of the user.

The hearing aid system 10 further comprises a wearable or hand-held device, such as a smartwatch 36, a smartphone 38, etc., facilitating data transmission between the hearing aids 12A, 12B and the wearable 36 or hand-held device 38 and possibly remote devices connected to the wearable or hand-held device through the Internet. The illustrated hearing aids 12A, 12B and the wearable 36 or hand-held device 38 are interconnected with, e.g., a Bluetooth Low Energy interface for exchange of sensor data and control signals between the hearing aids 12A, 12B and the wearable 36 or hand-held device 38. The illustrated wearable or hand-held device 36, 38 has a mobile telephone interface 50, such as a GSM-interface, for interconnection with a mobile telephone network and a WiFi interface 50 as is well-known in the art of smartphones. The wearable or hand-held device 36, 38 interconnects with the network 80 and possible remote servers (not shown) through the Internet with the WiFi interface 50 and/or the mobile telephone interface 50 as is well-known in the art of WANs.

The orientation sensors 44, such as gyroscopes, e.g. MEMS gyros, tilt sensors, roll ball switches, etc., are adapted for outputting signals for determination of orientation of the head of a user wearing the hearing aid 12A, e.g. one or more of head yaw, head pitch, head roll, or combinations hereof, e.g. tilt, i.e. the angular deviation from the heads normal vertical position, when the user is standing up or sitting down. E.g. in a resting position, the tilt of the head of a person standing up or sitting down is 0°, and in a resting position, the tilt of the head of a person lying down is 90°.

The wearable 36 or hand-held device 38 comprises a sound environment detector 52 for determining the category of the sound environment surrounding the user of the hearing aid system 10. The determining of the sound environment category is based on a sound signal picked up by a microphone 54 in the hand-held device. Based on the determination of the category, the sound environment detector 52 provides an output 56 to the adjustment processor 48 for calculation of sets $\widehat{\theta 1}$ and $\widehat{\theta 2}$ of signal processing parameters appropriate for the sound environment category in question and to be used by the respective first and second hearing loss signal processors 18A, 18B.

The sound environment detector 52 benefits from the computing resources and power supply typically available in the wearable 36 or hand-held device 38 that are larger than the resources and power supply available in the hearing aid 12A, 12B.

The sound environment detector 52 may categorize the current sound environment into one of a set of environmental categories, such as speech, babble speech, restaurant clatter, music, traffic noise, etc.

The adjustment processor 48 transmits a signal processor parameter control signal 58A, 58B to each of the hearing aids 12A, 12B, respectively, with information on the calculated sets $\widehat{\theta 1}$ and $\widehat{\theta 2}$ of signal processing parameters to be used by the respective first and second hearing loss signal processors 18A, 18B when executing their signal processing algorithms F(θ) in response to the signal processor parameter control signal 58A, 58B. Examples of signal processing parameters include: Amount of noise reduction, amount of gain and amount of HF gain, algorithm control parameters controlling whether corresponding signal algorithms are selected for execution or not, corner-frequencies and slopes of filters, compression thresholds and ratios of compressor algorithms, filter coefficients, including adaptive filter coefficients, adaptation rates and probe signal characteristics of adaptive feedback cancellation algorithms, etc.

The wearable 36 or hand-held device 38 includes a location detector 42 with a GPS receiver adapted for determining the geographical position of the hearing aid system 10. In absence of useful GPS signals, the position of the illustrated hearing aid system 10 may be determined as the address of the WIFI network access point or by triangulation based on signals received from various GSM-transmitters as is well-known in the art of smartphones.

The wearable 36 or hand-held device 38 may be adapted for transmission of determined sound environment categories and/or geographical positions to the adjustment processor 48 for determination of a signal processing parameter $\theta_i''$ values and/or a signal processing algorithm F appropriate for the determined sound environment category and/or determined geographical position.

The wearable 36 or hand-held device 38 may be adapted for transmission of determined sound environment categories and/or geographical positions to possible remote server(s) through the WiFi interface 50 and/or the mobile telephone interface 50. The adjustment processor 48 is adapted for recording the determined geographical positions together with the determined categories of the sound environment at the respective geographical positions. Recording may be performed at regular time intervals, and/or with a certain geographical distance between recordings, and/or triggered by certain events, e.g. a shift in category of the sound environment, a change in signal processing, such as a change in signal processing programme, a change in signal processing parameters, a user input entered with the user interface, etc., etc. The recorded data may be included in the preference probability distribution.

When the hearing aid system 10 is located within an area of geographical positions with recordings of a specific category of the sound environment, the adjustment processor 48 may be adapted for increasing the probability that the current sound environment is of the respective previously recorded category of the sound environment.

The wearable device 36 or the hand-held device 38 may also be adapted for accessing a calendar system of the user, e.g. through the WiFi interface 50 and/or the mobile telephone interface 50, to obtain information on the whereabouts of the user, e.g. meeting room, office, canteen, restaurant, home, etc., and to include this information in the determining of the category of the sound environment. Information from the calendar system of the user may substitute or supplement information on the geographical position determined by the GPS receiver and transmitted to the at least one server.

Also, when the user is inside a building, e.g. a high rise building, GPS signals may be absent or so weak that the geographical position cannot be determined by the GPS receiver. Information from the calendar system on the whereabouts of the user may then be used to provide information on the geographical position, or information from the calendar system may supplement information on the geographical position, e.g. indication of a specific meeting room may provide information on the floor in a high rise building. Information on height is typically not available from a GPS receiver.

Information on the orientation of the head of the user is also transmitted to the adjustment processor 48 to be included in the preference probability distribution and form basis for determination of signal processing parameters and/or algorithms of the hearing aid 12.

Although particular embodiments have been shown and described, it will be understood that they are not intended to limit the claimed inventions, and it will be obvious to those skilled in the art that various changes and modifications may be made without departing from the spirit and scope of the claimed inventions. The specification and drawings are, accordingly, to be regarded in an illustrative rather than restrictive sense. The claimed inventions are intended to cover alternatives, modifications, and equivalents.

The invention claimed is:

1. A hearing aid system comprising:

a first hearing aid with a first microphone for provision of a first audio signal in response to sound signals received at the first microphone from a sound environment, a first hearing loss signal processor that is configured to process the first audio signal in accordance with a signal processing algorithm to generate a first hearing loss compensated audio signal for compensation of a hearing loss of a user of the hearing aid system, wherein the signal processing algorithm is configured to apply a first set of signal processing parameters, a first output transducer for providing a first output signal to the user of the hearing aid system based on the first hearing loss compensated audio signal, and a first interface configured for data communication;

a user interface configured to receive a user input indicating a dissatisfaction of an output of the first hearing aid; and an adjustment processor that is configured for, in response to the user input indicating the dissatisfaction of the output of the first hearing aid:

determining a second set of signal processing parameter(s) comprising alternate value(s) for one or more of the signal processing parameters in the first set, and providing the second set of signal processing parameter(s) so that the first hearing loss signal processor can process the first audio signal with the signal processing algorithm applying the second set of signal processing parameter(s);

wherein the user interface and the adjustment processor are parts of the first hearing aid, or parts of one or more devices that are different from the first hearing aid.

2. The hearing aid system according to claim 1, wherein the adjustment processor is configured to repeat the functions of determining the second set of the signal processing parameter(s), and providing the second set of the signal processing parameter(s).

3. The hearing aid system according to claim 2, wherein the adjustment processor is configured to repeat the functions of determining the second set of the signal processing parameter(s), and providing the second set of signal processing parameter(s), when a predetermined time period has elapsed until a predetermined number of repetitions have been performed.

4. The hearing aid system according to claim 1, wherein the adjustment processor is configured to update a utility model U defined as:

$$U=\omega^T b$$

wherein b is a K-dimensional set of basis functions, and wherein ω is a K-dimensional vector comprising utility parameters for the utility model.

5. The hearing aid system according to claim 4, wherein the adjustment processor is configured to determine the second set of the signal processing parameter(s) by Thompson sampling of the second set of signal processing parameter(s) from a preference probability distribution p given by:

$$p = \frac{1}{Z} e^{\gamma \cdot EU},$$

wherein EU is an expected utility, γ is a scaling parameter, and Z is obtained from a normalization condition.

6. The hearing aid system according to claim 1, wherein the adjustment processor is configured to use Bayes rule to include the most recent response d in a preference probability distribution.

7. The hearing aid system according to claim 6, wherein the preference probability distribution is p(θ|D), and wherein the adjustment processor is configured to use Bayes rule to include the most recent response din the preference probability distribution p(θ|D) by calculation of a posterior distribution $\mathcal{N}(\tilde{\mu}, \tilde{\Sigma})$ of utility parameters ω with mean $\tilde{\mu}$ and covariance matrix $\tilde{\Sigma}$ based on the following:

$$p(\omega|D,d) \propto p(d|\omega) \cdot p(\omega|D),$$

wherein

D relates to observed data, d indicates user consent or user dissent, $$p(d \mid \omega) = \frac{1}{1 \mid e^{-\lambda(2d-1)(U_a-U_r)}} = g(\lambda(2d-1)(U_a-U_r)),$$

$$g(x)=1/(1+e^{-x}),$$

$$U_a=U(\theta_a,\omega),$$

$$U_r=U(\theta_r,\omega),$$

$\theta_a$ represents alternative hearing aid parameter values, and $\theta_r$ represents reference hearing aid parameter values.

8. The hearing aid system according to claim 7, wherein the adjustment processor is configured to perform a Laplace approximation to obtain a distribution of the utility parameters $\omega$ by updating $(\mu, \Sigma)$ to $(\tilde{\mu}, \tilde{\Sigma})$:

$$\tilde{\Sigma} = \Sigma - \frac{\hat{d}(1-\hat{d})}{\lambda^{-2} + \hat{d}(1-\hat{d})(\tilde{b}^T \Sigma \tilde{b})}(\Sigma\tilde{b})(\Sigma\tilde{b})^T$$

$$\tilde{\mu}=\mu+\lambda(d-\hat{d})\tilde{\Sigma}\tilde{b}$$

wherein $\tilde{b}=b(\theta_a)-b(\theta_r)$, $\tilde{d}=g(\lambda\omega^T\tilde{b})$, and $p(\omega|D)=\mathcal{N}(\mu, \Sigma)$ with mean $\mu$ and covariance matrix $\Sigma$.

9. The hearing aid system according to claim 1, wherein the one or more devices comprise a wearable device with a data interface that is configured for data communication with the first hearing aid;

wherein the user interface that is configured for entry of a dissent input or a consent input by the user.

10. The hearing aid system according to claim 9, wherein the adjustment processor is configured to transmit control signals to the first hearing aid using the data interface for controlling the first hearing loss signal processor to process the first audio signal with the signal processing algorithm applying the second set of the signal processing parameter(s).

11. The hearing aid system according to claim 1, further comprising a sound environment detector configured for:

determining a category of the sound environment surrounding the hearing aid system;

wherein the adjustment processor is configured for determining the second set of the signal processing parameter(s) of the first hearing aid of the hearing aid system based on the category of the sound environment determined by the sound environment detector.

12. The hearing aid system according to claim 1, further comprising a location detector configured for determining a geographical position of the hearing aid system;

wherein the adjustment processor is configured for determining the second set of the signal processing parameter(s) of the first hearing aid of the hearing aid system based the geographical position of the hearing aid system.

13. The hearing aid system according to claim 1, wherein the user interface is configured for allowing the user of the hearing aid system to adjust at least one of the signal processing parameters in the first set;

wherein the adjustment processor is configured for recording of the adjustment of the at least one of the signal processing parameters made by the user of the hearing aid system, and incorporating the adjustment made by the user in a preference probability distribution.

14. The hearing aid system according to claim 1, wherein the first hearing loss signal processor comprises the adjustment processor.

15. A method of in-situ fitting of a hearing aid, the hearing aid having a microphone for provision of an audio signal in response to sound signals received at the microphone from a sound environment, a hearing loss signal processor that is configured to process the audio signal in accordance with a signal processing algorithm to generate a first hearing loss compensated audio signal for compensation of a hearing loss of a user of the hearing aid system, the signal processing algorithm configured to apply a first set of signal processing parameters, and a first output transducer for providing a first output signal based on the first hearing loss compensated audio signal, the method comprising:

determining a second set of signal processing parameter(s) having alternate value(s) for one or more of the signal processing parameters in the first set; and providing the second set of signal processing parameter(s) so that the hearing loss signal processor can process the audio signal with the signal processing algorithm applying the second set of the signal processing parameter(s);

wherein the act of determining the second set of signal processing parameter(s) is performed in response to a user input indicating a dissatisfaction of an output of the hearing aid.

16. The method of claim 15, wherein the second set of signal processing parameter(s) is based on a learning algorithm.

17. The method of claim 16, wherein at least a part of the learning algorithm is implemented in a cloud computing network.

18. The method of claim 15, wherein the second set of signal processing parameter(s) is based on a probability distribution of a plurality of users of other hearing aids.

19. The method of claim 18, wherein the probability distribution is associated with a sound environment category.

20. The method of claim 18, wherein the probability distribution comprises at least one parameter selected from the group consisting of user audiogram, age, sex, race, height, and native language.

21. The hearing aid system of claim 1, wherein the user interface is configured to receive another user input indicating whether the user is satisfied or not.

22. The hearing aid system of claim 21, wherein the adjustment processor is configured to determine a third set of signal processing parameter(s) based on the other user input.

23. The method of claim 15, wherein the second set of signal processing parameter(s) is based on information regarding a current environment surrounding the user.

24. The method of claim 15, wherein the second set of signal processing parameter(s) is based on sound information obtained from a current environment surrounding the user.

25. The hearing aid system of claim 1, wherein the user interface and the adjustment processor are parts of a phone.

26. The hearing aid system of claim 1, wherein the user interface and the adjustment processor are parts of a wearable device.

27. The method of claim 15, wherein the act of determining is performed by a cloud computing network.

28. The method of claim 15, wherein the act of determining comprises calculating the second set of signal processing parameter(s).

29. The method of claim 15, wherein the user input is provisioned by a touchscreen.

30. The hearing aid system of claim 1, wherein the second set of signal processing parameter(s) is based on a learning algorithm.

31. The hearing aid system of claim 1, wherein the second set of signal processing parameter(s) is based on a probability distribution of a plurality of users of other hearing aids.

32. The hearing aid system of claim 31, wherein the probability distribution is associated with a sound environment category.

33. The hearing aid system of claim 31, wherein the probability distribution comprises at least one parameter selected from the group consisting of user audiogram, age, sex, race, height, and native language.

34. The hearing aid system of claim 1, wherein the second set of signal processing parameter(s) is based on information regarding a current environment surrounding the user.

35. The hearing aid system of claim 1, wherein the second set of signal processing parameter(s) is based on sound information obtained from a current environment surrounding the user.

36. The hearing aid system of claim 1, wherein the one or more devices comprise a cloud computing network.

37. The method of claim 15, wherein the act of determining is performed by a phone.

38. The method of claim 15, wherein the act of determining is performed by a wearable device.

39. The method of claim 15, wherein the act of determining is performed by the hearing aid.

* * * * *